US006775507B2

(12) United States Patent
Matsuura et al.

(10) Patent No.: US 6,775,507 B2
(45) Date of Patent: Aug. 10, 2004

(54) NON-FIXING TYPE IMAGE RECEIVING SHEET, IMAGE FORMING METHOD AND IMAGE FORMING APPARATUS

(75) Inventors: Masahiko Matsuura, Osaka (JP); Hiroshi Mizuno, Osaka (JP); Takaji Kurita, Osaka (JP); Masashi Yamamoto, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/988,628

(22) Filed: Nov. 20, 2001

(65) Prior Publication Data

US 2002/0098012 A1 Jul. 25, 2002

(30) Foreign Application Priority Data

| | | |
|---|---|---|
| Nov. 22, 2000 | (JP) | 2000-355961 |
| Nov. 22, 2000 | (JP) | 2000-355962 |
| Nov. 22, 2000 | (JP) | 2000-355963 |
| Nov. 22, 2000 | (JP) | 2000-355965 |

(51) Int. Cl.[7] ..... G03G 15/00; G03G 15/14
(52) U.S. Cl. ..... 399/297; 399/314; 399/390
(58) Field of Search ..... 399/1, 390, 296, 399/297, 314, 154, 343, 350, 354, 349, 127; 428/195, 34.2, 35.7, 141

(56) References Cited

U.S. PATENT DOCUMENTS

| | | | | |
|---|---|---|---|---|
| 5,113,226 A | * | 5/1992 | Tadokoro et al. | 399/390 |
| 6,529,704 B1 | * | 3/2003 | Kurita et al. | 399/390 |
| 6,577,827 B2 | * | 6/2003 | Matsuura et al. | 399/1 X |

FOREIGN PATENT DOCUMENTS

| | | |
|---|---|---|
| JP | 6-43682 | 2/1994 |
| JP | 2000-250249 | 9/2000 |
| JP | 2000-352908 | 12/2000 |
| JP | 2001-109183 | 4/2001 |

* cited by examiner

*Primary Examiner*—Sophia S. Chen
(74) *Attorney, Agent, or Firm*—Morrison & Foerster LLP

(57) ABSTRACT

A non-fixing type image receiving sheet to which toner particles are made adhere in a removable manner and an image forming apparatus. The image receiving sheet has a large number of concave portions accepting toner particles and a large number of convex portions protecting toner particles are formed on a surface of the image receiving sheet. The image forming apparatus has a sheet charging apparatus which charges the surface of the image receiving sheet to a polarity opposite to a charged polarity of toner particles, in advance of a transferring process.

20 Claims, 7 Drawing Sheets

NON-FIXING TYPE IMAGE RECEIVING SHEET, IMAGE FORMING METHOD AND IMAGE FORMING APPARATUS

BACKGROUND OF THE INVENTION

1. Field of the Invention

This invention relates to a non-fixing type image receiving sheet which is formed into an uneven surface and to which a toner adheres in a removable manner, an image forming method, and an image forming apparatus.

2. Description of Prior Art (Fixing Type Image Receiving Sheet)

In a printer which is used as an outputting means for personal computer, at present, a generally typical printing method is an electro-photography method in which toner particles are thermally fixed on an image receiving sheet comprising such as a paper or a plastic material, or an ink jet method in which an ink is dryly fixed on the image receiving sheet.

In each fixing method described above, a time is required for printing, an electricity bill and consumables such as the ink become necessary, so that a running cost is required. In addition, measures for decreasing an energy of the printer and decreasing consumption of paper are required in view of recent tendency in reduction of environmental load.

On the other hand, a paper outputted from the printer is necessary temporarily. However, it is usual that the paper becomes unnecessary and disused immediately after the paper is glanced once.

(Non-fixing Type Image Receiving Sheet)

In contrast with the above-mentioned methods, a method is generally known in which a transferred paper is reused. As a method for separating the toner from the transferred paper, for instance, there are known a method in which the transferred paper is passed through between a pair of heated rollers so as to melt and exfoliate the solidified toner, and a method in which the ink is removed by utilizing water solution such as surface active agent.

However, a large volume of energy is required for heating and for removing penetrating water content. In addition, the removed toner can not be reused because it is molten and solidified.

In order to solve such a problem, Published Patent Application (KOKAI) No. 43,682 is proposing a method in which fine projections are dispersedly formed on a surface of the image receiving sheet, a toner image is transferred on the surface of the image receiving sheet having the many fine projections and then fixed by being pressed to form an image, and the toner is separated from the image receiving sheet by means of a mechanical method, thus the image receiving sheet and the toner become reusable.

A mechanical means such as brushing etc. becomes popular as a means for removing the toner from the image receiving sheet. However, it is difficult to completely remove the toner so as not to leave contamination on the non-fixing type image receiving sheet having the many fine projections as describe above, by using the mechanical means only. In other words, toner particles remain around roots of the projections even when mechanically cleaning them by brushing, and the toner particles falling in concave portions become impossible to be removed when these fine concave portions exist.

Independently from the mechanical toner removing means, there is a measure for absorbing and removing the toner electrostatically by utilizing a magnetic brush.

Namely, this method is one in which a toner collecting magnetic brush is charged to a polarity opposite to that of charged polarity of the toner, the toner is absorbed to the magnetic brush by electrostatic absorption, thus the toner is removed from the surface of the image receiving sheet.

(Image Forming Apparatus)

FIG. 10 shows an example of a transferring apparatus (image forming apparatus) used for forming the toner image of the non-fixing type image receiving sheet, the apparatus is composed of a drum-type photoreceptor 127 and a transferring roller 128 facing on it. Around the photoreceptor 127, there are disposed a toner wiping-off (scratching-off) portion 131, an image charging portion 132, an exposing portion 133, and a developing portion 134; in an order from a transferring portion 130 contacting with the transferring roller 128 to a drum rotation direction side R.

The transferring roller 128 is applied with a bias to draw the toner particles. In order to carry out the transferring operation using such a transferring apparatus, the transferring roller 128 is applied with a bias to be charged to a positive polarity as shown by FIG. 11, when the toner particles are charged to a negative polarity. The toner particles charged to the negative polarity are drawn by the transferring roller 128 charged to the positive polarity and made adhere onto the surface of the image receiving sheet S.

3. Problems to be Solved by the Invention

According to the image receiving sheet as cited in Published Patent Application (KOKAI) No. 6-43682, the fine projection serves as a spacer at an upper part of the sheet so as to prevent the toner particles from adhering to a backside of an upper sheet which is placed upon the sheet surface. However, the projection does hardly fulfil its function to mechanically and securely retain the toner particles adhering to the sheet surface.

In addition, since the fine projections are formed only in the dispersed manner, there may be a case where the image receiving sheet on which the image has been formed is handled while the toner adheres to the fine projections of the image receiving sheet as it is. Although the toner is fixed to the projection by means of pressure treatment, the toner can be removed easily and mechanically from the image receiving sheet, so that fingers or sheet backsides may be contaminated when the sheet is touched with fingers or rubbed each other under piled condition.

Since the fine projections formed on the image receiving sheet are scattered independently as like a dotted pattern, they are apt to be deflected or deformed when an external force is applied. Therefore, foreign matters are apt to get in between the projections, the image is subjected to disturbance effect, and the toner image can not be protected enough.

A conventional image receiving sheet generally has a center line average roughness of sheet surface smaller than Ra=0.1 $\mu$m, so as to provide a smooth flat surface. For this reason, Funderworth Force of the toner particle becomes too large so that an adhering force of the toner particle to the sheet surface becomes large. Therefore, a good cleanability (toner removability) can not be obtained and recycling of the sheet may be prohibited. Further, since the center line average roughness Ra is small, a regular reflection light quantity (brilliance) will become too large and the image may not be seen well.

Even when the cleaning is done utilizing the electrostatic absorption by the magnetic brush, a carrier of the magnetic brush and the sheet surface layer (media) slide contacting each other, during the cleaning operation, to produce a friction charge on the sheet surface layer (or toner) so that a charge quantity on the sheet surface layer will increase.

When a conductive carrier is equipped for the carrier of the magnetic brush, an increased charge can be relieved from the conductive carrier to some extent. However, when an insulated resin carrier is equipped therefor, there is no path to let the above charge leak so that the charge quantity on the sheet surface layer will increase suddenly to cause an increase in a force to absorb the toner. For this reason, the removal ability of toner particles will decrease.

As illustrated in FIG. 10 and FIG. 11, in a method or an apparatus for carrying out the transferring operation by utilizing only the drawing effect of toner particles through means of the charge of the transferring roller 128, the transferring roller is located apart from the toner particles on the surface of photoreceptor with a distance longer than a thickness of the image receiving sheet. Thereby, its electric field is weakened so that there is a limit in improving its transferability and retentivity by controlling the applied voltage only.

SUMMARY OF THE INVENTION

1. Objects of the Invention

Objects of inventions are to provide an image receiving sheet which can be used repeatedly, to improve a mechanical retentivity as compared with the image receiving sheet described in Published Patent Application (KOKAI) No. 6-43682, and to improve a desired property as demanded by consumers with regard to properties such as a toner retentivity including electric factor, a toner transferability and a cleaning ability (toner removability).

An object of the invention is to improve three properties of the electric toner: the retentivity, the toner transferability and the cleanability (toner removability), as a whole.

An object of the invention is to further improve the above-mentioned three properties in all.

An object of the invention is to further improve particularly the transferability and the retentivity.

An object of the invention is to provide an image receiving sheet which can be used repeatedly, to improve a mechanical retentivity as compared with the image receiving sheet described in Published Patent Application (KOKAI) No. 6-43682, and to improve even the cleanability (toner removability).

An object of the invention is to further improve the mechanical retentivity.

Other objects of the invention are to provide an image receiving sheet which can be used repeatedly, and to improve the retentivity of toner particles and the cleanability (toner removability).

Other objects of the invention are to improve the transferability and retentivity of toner particles in the image forming method and image forming apparatus of the non-fixing type image receiving sheet.

2. Solution for the Problems (1) In order to accomplish the above objects, the invention is characterized by that, in the non-fixing type image receiving sheet to which toner particles are made adhere in a removable manner, a large number of concave portions accepting toner particles and a large number of convex portions protecting toner particles are formed on a surface of the image receiving sheet, and a sectional structure of the image receiving sheet is composed of a multilayer structure which includes at least a sheet surface layer having the above concave portions and convex portions and a sheet core layer.

(2) The invention according to an embodiment is characterized by that, in the non-fixing type image receiving sheet, volume resistivities of respective layers are different from each other.

(3) The invention according to another embodiment is characterized by that, in the non-fixing type image receiving sheet, a volume resistivity of the sheet surface layer is larger than a volume resistivity of the sheet core layer.

(4) The invention according to yet another embodiment is characterized by that, in the non-fixing type image receiving sheet, a volume resistivity of the sheet surface layer is set to 1012 Ω.cm or larger and a volume resistivity of the sheet core layer is set to 104 Ω.cm or larger and to 1010 Ω.cm or smaller.

(5) The invention according to another embodiment is characterized by that, in the non-fixing type image receiving sheet, the concave portion forming the above uneven surface is formed into a grooved shape and the convex portion is formed into a convex stripe extending along the grooved concave portion.

(6) The invention according to another embodiment is characterized by that, in the non-fixing type image receiving sheet to which toner particles are made adhere in a removable manner, a large number of concave portions accepting toner particles and a large number of convex portions protecting toner particles are formed on the surface of the image receiving sheet, and a center line average roughness Ra of the surface of the image receiving sheet is set to 0.2 μm or larger and to 1.0 μm or smaller.

(7) The non-fixing type image receiving sheet is characterized by that, in the non-fixing type image receiving sheet, the concave portion composing the above uneven surface is formed into a grooved shape, and the convex portion is formed into a ridged-shape convex stripe extending along the grooved-shape concave portion.

(8) The invention according to another embodiment is characterized by that, in the non-fixing type image receiving sheet to which toner particles are made adhere in a removable manner, a large number of concave portions accepting toner particles and a large number of convex portions protecting toner particles are formed on the surface of the image receiving sheet, and the surface of the image receiving sheet forming the concave portion and convex portion is made of high-molecular compound including fine particles of metal oxide.

(9) The invention according to another embodiment is characterized by that, in the non-fixing type image receiving sheet, a content of the fine particles of metal oxide is set to 0.1 g through 2 g per square meter of the image receiving sheet.

(10) The invention according to another embodiment is characterized by that, in the non-fixing type image receiving sheet, fine particles of zinc oxide, titanium oxide or alumina are contained for use as the fine particles of metal oxide.

(11) The invention according to another embodiment is characterized by that, in the non-fixing type image receiving sheet, fine particles of calcium carbonate or silica are contained in place of the metal oxide.

(12) The invention according to another embodiment is characterized by that, in the image forming method for the non-fixing type image receiving sheet to which toner particles are made adhere in a removable manner, a large number of concave portions accepting toner particles and a large number of convex portions protecting toner particles are formed on the surface of the image receiving sheet, and the surface of the image receiving sheet is charged to a polarity opposite to the charged polarity of toner particles for serving as a pre-process, in advance of transferring the toner image to the image receiving sheet.

(13) The invention according to another embodiment is characterized by that, in the image forming apparatus for the non-fixing type image receiving sheet to which toner particles are made adhere in a removable manner, a large number of concave portions accepting toner particles and a large number of convex portions protecting toner particles are formed on the surface of the image receiving sheet, and there are installed two apparatuses: a transferring apparatus which transfers the toner image to the surface of image receiving sheet, and a sheet charging apparatus which charges the surface of the image receiving sheet to a polarity opposite to the charged polarity of the toner particles, in advance of the transferring process carried out by the transferring apparatus.

3. Advantages of the Inventions

As explained above, according to the invention of the present application, following advantages become obtainable.

(1) Since the non-fixing type image receiving sheet is used to which the toner particles are made adhere in a removable manner; the image receiving sheet can be reused, a consumption of paper can be reduced, an energy and expendable supplies as required for the fixing type becomes unnecessary, the toner collected from the image receiving sheet can be reused, so that a running cost can be minimized.

(2) Since a large number of concave portions for receiving the toner particles and a large number of convex portions for protecting the toner particles are formed on the surface of the image receiving sheet S; the toner particles are mechanically and securely held in the concave portion, the plural convex portions increase the above-mentioned mechanical holding ability, and the convex portions serve as spacers so that the convex portions can securely prevent foreign matters (such as fingers or other sheet backsides) from contacting with the sheet from upside and can improve the mechanical retentivity.

(3) When many concave portions and convex portions are formed on the sheet surface, and the sectional structure of image receiving sheet is formed at least into the multilayer structure including the sheet surface layer having the uneven surface together with the sheet core layer; the volume resistivity for each layer can be easily changed in relation to the transferability, the retentivity and the cleanability, thereby the image receiving sheet improved in its property can be provided according to demands of customers.

(4) When the volume resistivity $\rho$1 of the sheet surface layer is made larger than the volume resistivity $\rho$2 of the sheet core layer, results as listed for the sample sheets SP1 through SP8 in Table 2 are obtained, so that a possibility becomes large in making up the image receiving sheet having a good transferability, retentivity and cleanability.

(5) The volume resistivity $\rho$1 of the sheet surface layer 2 is set to $10^{12}$ Ω.cm or larger and the volume resistivity $\rho$2 of the sheet core layer 3 is set to $10^{4}$ Ω.cm or larger and $10^{10}$ Ω.cm or smaller, it becomes possible that all of the image receiving sheets can securely present good transferability, retentivity and cleanability.

In concrete, sufficient transferring electric field can be obtained in the transferring region, thereby the transferability can be improved. In the cleaning region, the potential removing effect of the image receiving sheet can be made better at time of peeling-off of the toner particles and the cleanability can be improved, so that it becomes possible to form a stable image. In addition, when the image receiving sheets on which images have been formed are placed one upon another; an electrostatic shielding effect can be obtained, a toner absorbing force can be secured with respect to the sheet surface layer, and an image retentivity can be kept high.

(6) When the concave portion composing the uneven sheet surface is formed into the grooved-shape and the convex portion is formed into the ridged-shape (convex stripe) extending along the grooved concave portion, the mechanical retentivity is improved further and the image receiving sheet providing a high resolution and a high contrast can be realized.

(7) Since the center line average roughness Ra of the image receiving sheet is set to 0.2 μm or larger and 1.0 μm or smaller, a good cleanability can be obtained and an appropriate brilliance, which is hard to produce a brilliant after image, can be obtained as obvious from Table 3. In other words, the cycle stability can be improved and a visible image controlled in its brilliance can be obtained.

(8) Since the fine particles of metal oxide such as titanium dioxide or the fine particles of silica, calcium carbonate etc. are contained in the thermosetting or thermoplastic sheet surface layer; a good cleanability can be secured by releasing the overcharging caused by friction charging, while maintaining the toner particle retaining force produced by a proper electrostatic drawing force.

(9) The mechanical retentivity of toner particle can be improved especially by forming a number of concave portions and a number of convex portions on the sheet surface layer 2 as described above. However, even when these concave portions and convex portions disturb the cleaning operation utilizing the magnetic brush and the friction charging is apt to be produced, the overcharging can be properly released and the cleanability can be improved securely.

(10) When the content of fine particles of metal oxide such as titanium dioxide is set to 0.1 g to 2 g per square meter of the image receiving sheet, the effect of its cleanability becomes more remarkable.

(11) Since the surface of the image receiving sheet is charged (pre-charging) to the polarity opposite to the charged polarity of the toner by means of the sheet charging apparatus in the pre-process wherein the toner image is transferred to the image receiving sheet; the transferring electric field becomes substantially large so that the transferability is improved in the transferring process.

(12) Since the surface of the image receiving sheet is charged to the polarity opposite to the charged polarity of the toner particles, the toner particles can be held under electrostatic stable condition and the image retentivity can be improved because the charge exists at the surface side of the image receiving sheet.

(13) Since the image receiving sheet itself is charged, the toner particles adhere electrostatically and strongly to the sheet surface. Therefore, even if the image receiving sheets on which images are formed are placed one upon another, such a phenomenon (so-called a backside copying phenomenon) does not occur wherein the toner particles move to a backside of an opponent sheet.

DETAILED DESCRIPTION OF THE PREFERRED EMBODIMENTS

1. Embodiment 1

(Structure of Non-Fixing Type Image Receiving Sheet)

Figure 1:
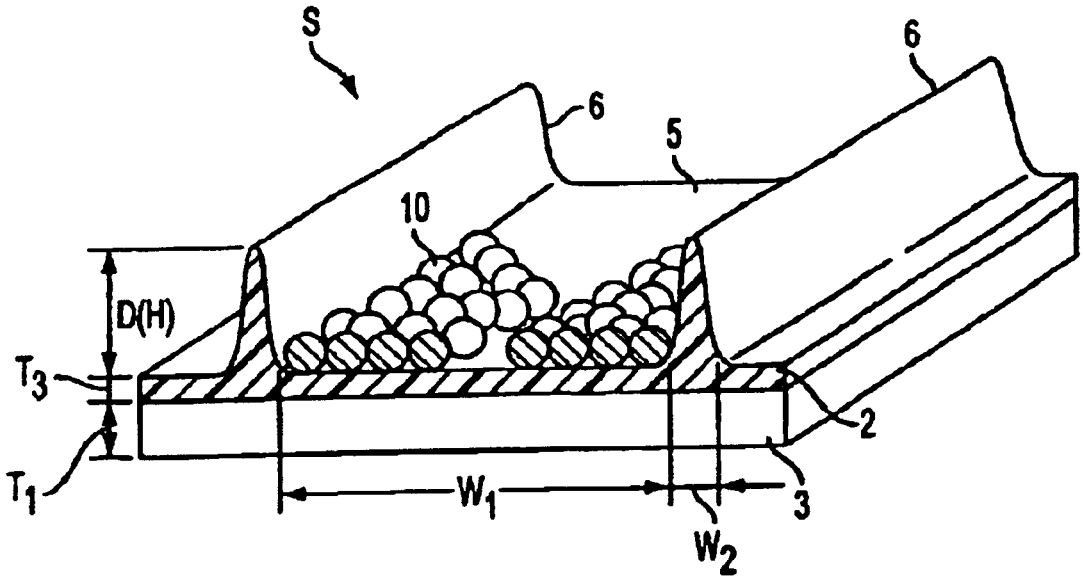
FIG. 1 is an enlarged vertical sectional partial oblique view of a non-fixing type image receiving sheet to which the present invention of this application is applied.

FIG. 1 is the enlarged vertical sectional partial oblique view of the non-fixing type image receiving sheet S to which the present invention of this application is applied. A sectional structure of the image receiving sheet S is composed of a multilayer structure (double-layer structure) comprising a sheet surface layer 2 and a sheet core layer 3. A surface of the sheet surface layer 2 is composed of an uneven surface on which large numbers of a concave portion 5 and a convex portion 6 are formed. The sheet surface layer 2 and the sheet core layer 3 are provided with different volume resistivities ρ1 and ρ2 respectively. In the present embodiment, the volume resistivity ρ1 of the sheet surface layer 2 is set larger than the volume resistivity ρ2 of the sheet core layer 3. A volume resistivity of the sheet surface layer 2 is set to $10^{12}$ Ω.cm or larger and a volume resistivity of the sheet core layer 3 is set to $10^{4}$ Ω.cm or larger and to $10^{10}$ Ω.cm or smaller.

A center line average roughness Ra of the surface of the sheet surface layer 2 is set to 0.2 μm or larger and to 1.0 μm or smaller.

A concave portion 5 is formed into a continuous grooved shape, and a convex portion 6 has a ridged shape extending along the grooved concave portion 5 and is formed into a so-called convex stripe.

The grooved concave portions 5 are installed in parallel with each other with the same width W1 put between them, for instance, regularly in order to receive a toner 10. It is desirable that the width W1 of the concave portion 5 is larger than two times of an average particle diameter of the toner 10. In relation to an average particle diameter of the toner 10 of 2 μm to 30 μm, the width W1 of each grooved concave portion 5 preferably ranges from 20 μm to 500 μm, and a depth D (height H of convex portion) preferably ranges from 20 μm to 100 μm. It is desirable that a width W2 of a convex portion 6 is set to a half or smaller and a fiftyth or larger of the width W1 of the grooved concave portion 5.

As illustrated in FIG. 1, the concave portion 5 is formed into the continuous grooved shape, and the convex portion 6 is formed into the ridged-shape convex stripe portion 6 extending along the continuous grooved-shape concave portion 5. Thereby, the convex stripe 6 serves as a spacer of the width W1 and an upper space of the concave portion 5, the toner adhering to a specified position of a bottom surface of the grooved concave portion 5 is held mechanically and stably. there is no possibility for a backside of upper image sheet to be contaminated by the toner even when image sheets completed with image formation are placed one upon another. In addition, there is no possibility for hands or image receiving sheet surfaces to be contaminated even when the surface of image sheet is touched with hands because the toner is protected by the convex stripe portion 6.

The center line average roughness Ra of the surface of the sheet surface layer 2 is set to 0.2 μm or larger and 1.0 μm or smaller. Thereby, the Funderworth Force of toner particles does not become too large and too small, a good cleanability (toner removability) can be maintained. In addition, the regular reflection light quantity does not become too large so that so-called "shining" phenomenon can be avoided, and a proper brilliance can be obtained to provide a comfortable readable printing surface.

The image receiving sheet S can be made of materials such as paper, synthetic resin (polyester, polyethylene terephthalate, polyolefin [polypropylene, polyethylene etc.], polyimide, polyamide etc.) independently or in combination use of them.

Materials and structures of respective layers 2 & 3 will be described in details hereunder. The sheet core layer 3 is made of a plain paper for use generally in a copying machine etc., and the sheet surface layer 2 is made of high-molecular compound or thermoplastic resin such as polyethylene, acryl, polyester etc., for example. The sheet surface layer 2 uniformly contains fine particles of metal oxide such as titanium dioxide, zinc oxide or alumina etc., or fine particles of inorganic compound such as silica, clay or talc having semi-conductive characteristics. Contents of fine particles of these titanium dioxide preferably range from 0.1 g to 2 g per square meter of the image receiving sheet. The thermosetting resin may be used for the sheet surface layer 2.

(Manufacturing Method of Non-Fixing Type Image Receiving Sheet)

As illustrated in FIG. 1, a method will be described hereunder, in which the sheet surface layer 2 having the uneven surface is formed on the sheet core layer 3 in the multilayer structure. On the sheet core layer 3 comprising a paper etc. for instance, a layer of synthetic resin (thermoplastic resin such as polyethylene, acryl, polyester, etc. for example) or a layer of sheet surface material prepared by mixing white pigment or extender pigment into titanium oxide, zinc oxide, silica, alumina, clay, talc etc.; is formed by using a forming mold (master roller, for instance) on which a pattern for enabling formation of the specified continuous grooved concave portion 5 is formed, thus the uneven surface can be formed. The uneven surface may be made by molding resin in the forming mold.

A method may be mentioned wherein a polymer film utilized as a so-called resist is formed on the sheet core layer 3, the film is subjected to exposing treatment through a visor mask, and a portion corresponding to the continuous grooved concave portion 5 is removed. Another method may be mentioned in concrete, wherein a film of polymer enabling photopolymerization is formed on the sheet core layer 3, the film is subjected to the exposing treatment through the visor mask, thereafter, the portion corresponding to the continuous grooved concave portion 5 is removed by washing.

The center line average roughness Ra of the sheet surface layer 2 can be controlled by adjusting a quantity of the inorganic fine particles (silica) when the inorganic fine particles (silica) are dispersed in and mixed with a surface of pattern forming mold (silicon rubber).

(Image Forming Apparatus)

Figure 3:
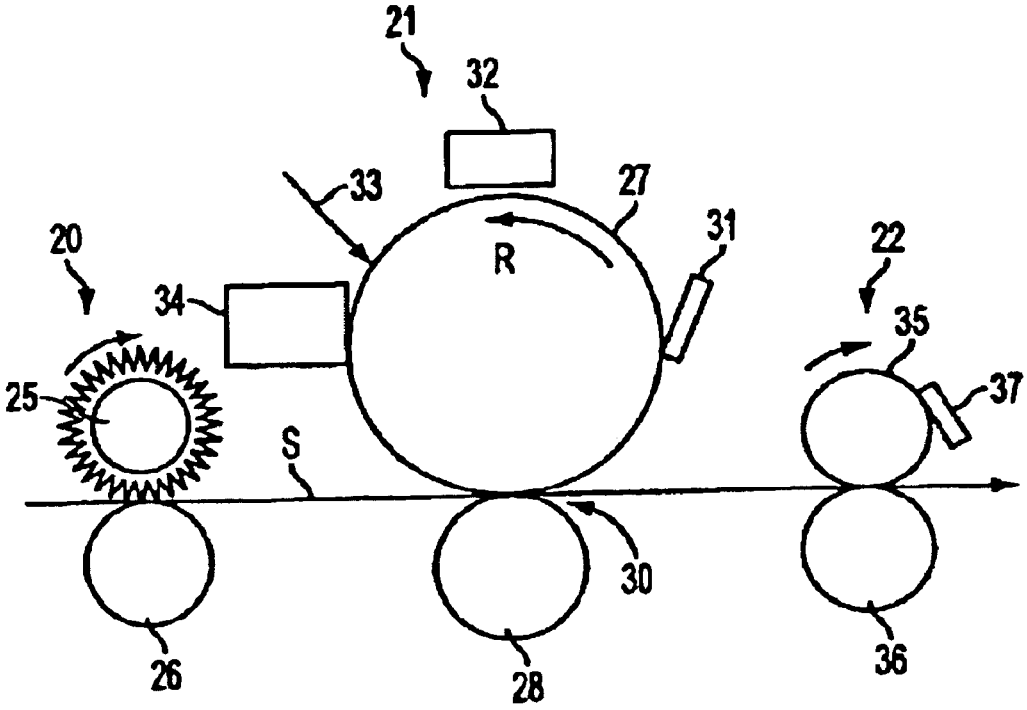
FIG. 3 is a simplified side view of an image forming apparatus.

FIG. 3 shows an example of the image forming apparatus having no pre-charging apparatus. A cleaning apparatus (toner removing apparatus) 20 is disposed at a feed-start side (left side of FIG. 3) of an image forming apparatus 21, and a convex stripe cleaning apparatus (convex stripe toner removing apparatus) 22 is disposed at a feed-end side (right side of FIG. 3). The cleaning apparatus 20 is composed of a collecting conductive brush roller 25 and a counter roller 26. The image forming apparatus 21 is composed of a drum-type photoreceptor 27 and a transferring roller 28 facing the former. There are disposed around the photoreceptor 27; a toner wiping-off portion (scratching-off portion) 31, an image charging portion 32, an exposing portion 33 and a developing portion 34, in a direction from a transferring portion 30 contacting with the transferring roller 28 to a drum rotation direction R side, in this order. The transferring roller 28 is applied with a bias drawing the toner particles. The convex stripe cleaning apparatus 22 is composed of a charged roller 35 and a counter roller 36, and a toner wiping-off portion 37 is disposed on the charged roller 35.

(Image Forming Method)

An image forming method using the image forming apparatus 21 of FIG. 3 will be described hereunder.

(1) In the image forming apparatus 21, a surface of the photoreceptor 27 is uniformly charged to about −900V in the image charging portion 32, and is exposed according to image data so as to form an electrostatic latent image on the surface of the photoreceptor 27 in the exposure portion 33. On the surface of the photoreceptor 27, an exposed area decays down to about −100V and a non-exposed area is retained at about −900V. Thereafter, the toner particles (negative polarity) are made adhere to the photoreceptor 27 according to the electrostatic latent image in the developing portion 34.

(2) When the image receiving sheet S is reused, the toner particles in the grooved stripe concave portion 5 is once removed in the cleaning apparatus 20. Even when the sheet is not reused, the surface is cleaned as occasions demand and it is transported to the transferring portion 30 of the image forming apparatus 21.

(3) At the transferring portion 30 of the image forming apparatus 21, the toner particles of the electrostatic latent image adhering to the photoreceptor 27 are transferred to the uneven surface of the image receiving sheet S transported from the cleaning apparatus 20. In this instance, the transferring roller 28 is applied with a bias of about +1 kV, for example.

Figure 4:
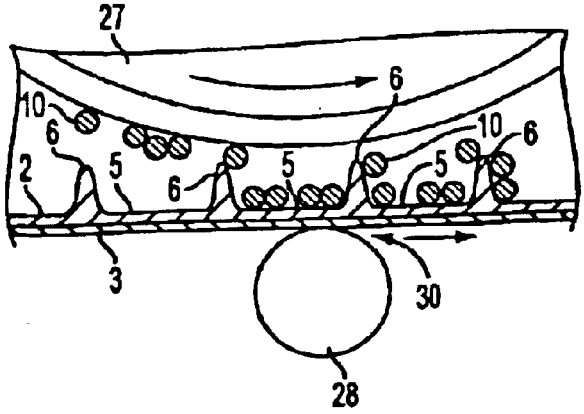
FIG. 4 is an enlarged vertical sectional view of a transferring portion of the image forming device.

FIG. 4 is the enlarged view of the transferring portion 30. Almost all of the toner particles 10 adhering to the surface of the photoreceptor 27 will adhere to the bottom face of the grooved concave portion 5. However, some part of the particles will adhere to the convex stripe portion 6 too. When carrying out the transferring operation; the convex stripe portion 6 serves as a spacer between the photoreceptor 27 and the bottom face of the grooved concave portion 5, it prevents the bottom face of the grooved concave portion 5 from getting too near to the photoreceptor 27, and it securely holds a proper electric field distance, thereby providing a good transferability.

Figure 5:
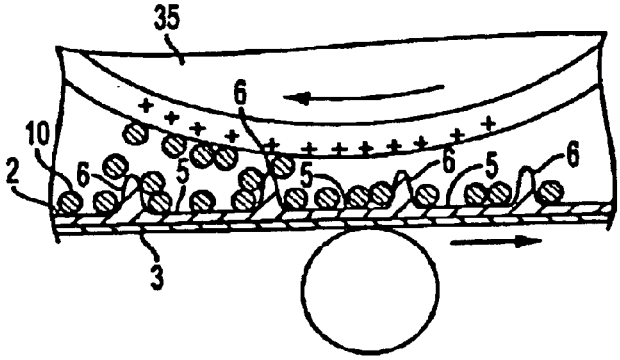
FIG. 5 is an enlarged vertical sectional view of a convex stripe cleaning apparatus.

(4) The image receiving sheet S to which the toner image has been transferred is transported to the convex stripe cleaning apparatus 22 of FIG. 3, and the toner particles 10 adhering to the convex stripe portion 6 are collected by an electrostatic force of a charged roller (positive charge) 35, as shown in FIG. 5. In this instance, the collecting conductive brush roller 25 is applied with a bias of about +300V, and a counter roller 26 is grounded, as shown in FIG. 3.

(5) In case when the image receiving sheet S on which the image has been formed is to be used again, it is transported to the sheet cleaning apparatus 20 of FIG. 3, and the toner particles adhering to the concave portion 5 are collected. In this instance, a collecting conductive brush roller 25 is applied with a bias of about +1 kV having a polarity opposite to the charged polarity of toner particles, and a counter roller 26 is grounded.

(Cleaning Apparatus)

Figure 7:
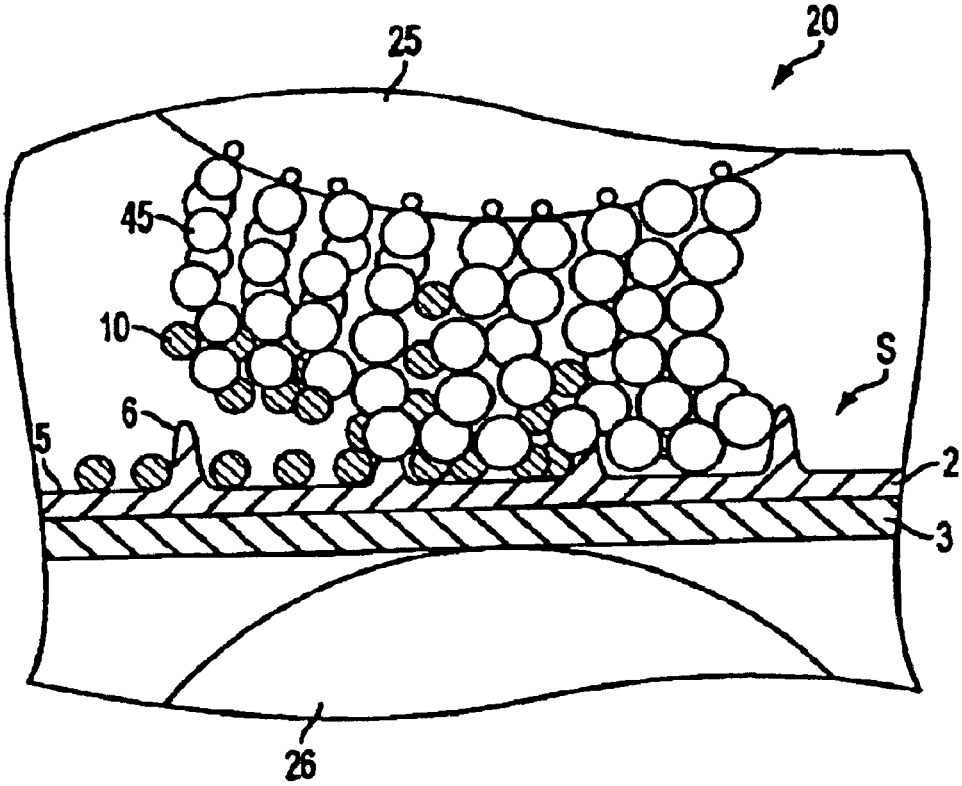
FIG. 7 is an enlarged vertical sectional view of the cleaning apparatus.

FIG. 7 shows an enlarged view of the magnetic brush roller 25. A magnetic brush for developing is used for the magnetic brush roller 25. A pile portion of the brush roller 25 is used for the carriers 45. A conductive carrier comprising iron powder or an resin carrier prepared by mixing resin and magnetite, are used for the carriers 45 of the magnetic brush roller 25. The magnetic brush roller 25 is applied with a bias to a polarity opposite to a polarity (negative polarity) of the toner particles 10, and the counter roller 26 is grounded.

(Cleaning Method(Method for Removing Toners))

In FIG. 7, toner particles 10 on the image receiving sheet S are charged to a negative polarity and adhered to the sheet surface layer 2. The toner particles 10 are removed mechanically by the carriers 45 of the rotating magnetic brush, and at the same time the toner particles 10 are removed electrostatically from the surface of the image receiving sheet by the carriers 45 charged to a positive polarity.

In cleaning operation, a friction charge is produced on the sheet surface layer (media) 2 by friction contact between the sheet surface layer 2 and the carrier 45, and a charge quantity of the surface of the image receiving sheet increases, thereby an absorption force between the toner particles 10 and the sheet surface layer 2 is intend to strengthen. However, since the fine particles of metal oxide for example titanium oxide exit thereof, it becomes possible to leak off properly the increased charge quantity. As the result, a charge up in the sheet surface layer 2 is prevented and the carriers 45 absorb properly the toner particles 10 with an electrostatic absorption thereof. Namely, it becomes possible to keep a good cleaning operation by the magnetic brush.2.

2. Example Relating to Volume Resistivity

The following Table 1 is a table in which the volume resistivity ρ1 of the sheet surface layer 2 and the volume resistivity ρ2 of the sheet core layer 3 are changed and combined variously, in the image receiving sheet S having a multilayer structure including the sheet surface layer 2 and the sheet core layer 3 as illustrated in FIG. 1.

In a concrete example for forming the sheet core layer 3 and the sheet surface layer 2, the sheet core layer 3 was uniformly coated with thermoplastic resin (high-molecular polyethylene) adjusted in its volume resistivity by varying a blending (dispersing) quantity of carbon particles, a shape forming mold was placed on the layer and thermally pressed (at 120° C., for 30 min., with 10 kg/cm$^2$), and the layer was then cooled and separated from the mold, thus the surface shape was transferred. The uneven shape of this instance was as follows: a width of concave portion of FIG. 1 W1=200 μm, a width of convex portion W2=10 μm, and a height H=50 μm. A minimum thickness of the sheet surface layer 2 (thickness of sheet surface layer of concave bottom portion) T1 was about 20 μm.

A material prepared by rolling polyethylene terephthalate mixed with carbon particles etc. into a sheet having a thickness of about 80 μm, was used for the sheet core layer 2. The volume resistivity was adjusted by changing the blending quantity and dispersing quantity of the carbon particles.

Figure 2:
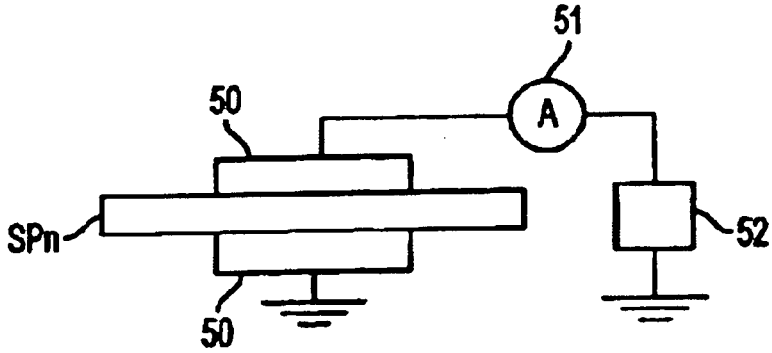
FIG. 2 is a wiring diagram of a volume resistivity measuring device.

The volume resistivities ρ1 and ρ2 of respective layers 2 and 3 were measured by preparing sample sheets SP1 to SP10 (having thicknesses of about 100 μm) using various resins, and by utilizing a volume resistivity measuring apparatus as shown in FIG. 2. The volume resistivity measuring apparatus is equipped with a pair of disc type electrodes 50 & 50 having the same area (ϕ30 mm), one electrode 50 is connected through an ammeter 51 to a constant-voltage power source (500 V) 52, and the other electrode 50 is grounded. A sample sheet SPn having a specified thickness is sandwiched between the both electrodes 50, a voltage is applied to measure a current, thus calculating the volume resistivity ρ.

Concerning the sample sheets SP1 through SP6 in table 1; the volume resistivity ρ1 of the sheet surface layer 2 is kept at such large value as $5.4\times10^{13}$, and the volume resistivity ρ2 of the sheet core layer 3 is increased in an order from the sample sheet SP1 to SP6 within a range smaller than the volume resistivity ρ1 of the sheet surface layer 2. Concerning the sample sheets SP7 and SP8; the volume resistivity ρ2 of the sheet core layer 3 is kept at such a middle value as $7.6\times10^{7}$, and the volume resistivity ρ1 of the sheet surface layer 2 is decreased in an order from the sample sheet SP7 to SP8 within a range larger than the volume resistivity ρ2 of the sheet core layer 3. Concerning the sample sheets SP9 and SP10; the volume resistivity ρ2 of the sheet core layer 3 is made larger than the volume resistivity ρ1 of the sheet surface layer 2, in the way reverse to the sample sheets SP1 to SP8.

| Sample sheet | Volume resistivity of sheet core layer ρ2 (Ω · cm) | Volume resistivity of sheet surface layer ρ1 (Ω · cm) |
|---|---|---|
| SP1 | $3.3 \times 10^{3}$ | $5.4 \times 10^{13}$ |
| SP2 | $5.2 \times 10^{4}$ | $5.4 \times 10^{13}$ |
| SP3 | $7.6 \times 10^{7}$ | $5.4 \times 10^{13}$ |
| SP4 | $1.2 \times 10^{9}$ | $5.4 \times 10^{13}$ |
| SP5 | $2.3 \times 10^{10}$ | $5.4 \times 10^{13}$ |
| SP6 | $8.4 \times 10^{12}$ | $5.4 \times 10^{13}$ |
| SP7 | $7.6 \times 10^{7}$ | $2.8 \times 10^{12}$ |
| SP8 | $7.6 \times 10^{7}$ | $1.1 \times 10^{11}$ |
| SP9 | $1.2 \times 10^{9}$ | $8.2 \times 10^{8}$ |
| SP10 | $7.6 \times 10^{7}$ | $4.8 \times 10^{6}$ |

Table 2 shown below lists the transferability, retentivity and cleanability of respective image receiving sheets (SP) to which respective volume resistivities ρ1 and ρ1 listed in Table 1 are applied.

The transferability is evaluated as (0) if a percentage of transferring onto the image receiving sheet is 80% or larger, and as (X) if the percentage is smaller than that, when an adhering quantity to the image receiving sheet is measured in relation to an adhering quantity to the photoreceptor before being transferred.

The retentivity is evaluated as (0) if no contamination is found on the sheet backside, and as (X) if the contamination is found, when the image receiving sheets on which images are formed are placed upon another and the sheet backside is visually evaluated with respect to its contamination.

The cleanability is evaluated as (0) if no after image is found, and evaluated as (X) if after image is found, when the sheets on which images are formed are made pass through the cleaning apparatus 20 of FIG. 3 and after images on the image receiving sheets are visually evaluated at a spot immediately before the transferring portion.

TABLE 2

| Image receiving sheet (Sample sheet) | Transferability | Retentivity | Cleanability |
|---|---|---|---|
| SP1 | X | ○ | ○ |
| SP2 | ○ | ○ | ○ |
| SP3 | ○ | ○ | ○ |
| SP4 | ○ | ○ | ○ |
| SP5 | X | X | X |
| SP6 | X | X | X |
| SP7 | ○ | ○ | ○ |
| SP8 | ○ | X | ○ |
| SP9 | ○ | X | ○ |
| SP10 | ○ | X | ○ |

From Table 2, following facts become clear concerning the transferability, retentivity, and cleanability.

(Transferability)

In case where the volume resistivities ρ1 and ρ2 are too large for both the sheet surface layer 2 and the sheet core layer 3; a resistance will become large in a direction of thickness of the image receiving sheet, an electric field of transferring region can not be secured enough, and the toner can not move sufficiently. In other words, as shown in the cases of sample sheets SP5 and SP6 listed in table 2, the transferability can not be improved In case where the volume resistivity ρ2 of the sheet core layer 3 is too small; a transferred bias will leak through the sheet core layer 3 to the counter roller (sheet cleaning apparatus or convex stripe cleaning apparatus), and there would happen a case where the transferred electric field is not applied sufficiently. Namely, as shown by the sample sheet SP1 listed in Table 2, a good transferability can not be expected.

(Retentivity)

In case where the volume resistivities ρ1 and ρ2 are too large for both the sheet surface layer 2 and the sheet core layer 3; a charge having a polarity opposite to the charged polarity of the toner is accumulated on a backside of the sheet core layer 3, and an electrostatic force is produced between it and the toner particles existing in the concave portions of the image receiving sheet insides when the image receiving sheets are placed upon another, so that the particles are absorbed to the backside of the upper image receiving sheet. In other words, as shown by the sample sheets SP5 and SP6 listed in Table 2, the retentivity is not improved.

In case where the volume resistivity ρ1 of the sheet surface layer 2 is too small; an electrostatic absorption force between the toner particles and the sheet surface layer becomes small, and an image disturbing phenomenon will occur. Namely, as shown by the sample sheets SP8, SP9 and SP10 listed in Table 2, the resistivity is not improved.

(Cleanability)

In case where the volume resistivities ρ1 and ρ2 are too large for both the sheet surface layer 2 and the sheet core layer 3; a resistance becomes large in a direction of thickness of the image receiving sheet, the charge is not eliminated enough when the toner particles are peeled off, the charge is accumulated on the surface of image receiving sheet, so that the next image formation is affected. In other words, as shown by the sample sheets SP5 & SP6 listed in Table 2, the cleanability is not improved so much.

In order to preferably improve all of three properties: the transferability, retentivity and cleanability, it is an important point that the volume resistivity ρ1 of the sheet surface layer ρ2 should be made large and the volume resistivity ρ2 of the sheet core layer 3 should be made small, as shown by the sample sheets SP2 through SP4 and SP7 listed in Table 1 and Table 2. In concrete, good results could be obtained when the volume resistivity ρ1 of the sheet surface layer 2 was $10^{12}$ Ω.cm or larger and the volume resistivity ρ2 of the sheet core layer 3 was $10^{4}$ Ω.cm or larger and $10^{10}$ Ω.cm or smaller (corresponding to the sample sheets SP2 through SP4).

3. Example Relating to Surface Roughness

Sample sheets SP1 through SP10 having various center line average roughnesses Ra were made up for serving as the image receiving sheet of FIG. 1, and the cleanability and brilliance were compared in the following Table 3.

A manufacturing method of the sample sheets SPn will be described hereunder in details. Thermoplastic resin (high-molecular polyethylene) was uniformly coated on the sheet core layer 2 prepared by forming polyethylene terephthalate into a sheet having a thickness of about 80 μm. Then, a shape forming mold (silicon rubber) was placed on the sheet to carry out thermal pressing (at 120° C., for 30 min., with 10 kg/cm$^2$). Thereafter, the sheet was cooled and separated from the mold, thus the surface shape was transferred. In this instance, a surface roughness of the shape forming mold was adjusted by dispersing and mixing inorganic fine particles (silica) on the surface of the shape forming mold (silicon rubber), thus the center line average roughness of the sheet surface layer 2 was controlled. The transferred uneven shape of this instance was as follows: in FIG. 1., a width of concave W1=200 μm, a width of convex W2=10 μm, a height D(H)=50 μm. A minimum thickness of the sheet surface layer 2 (thickness of surface layer of concave bottom portion) T3 was about 20 μm.

As described above, the sample sheets SP1 through SP10 having various center line average roughness Ra listed in Table 3 were made up by controlling quantities of inorganic fine particles dispersed in and mixed with the surface of the shape forming mold (silicon rubber).

The center line average roughness Ra was measured by the surface roughness measuring machine "Surf Com 554A" (made by Tokyo Seimitsu Co., ltd.) using the pickup E-DT-S02A for measuring soft substance.

TABLE 3

| Sample sheet SP | Surface roughness Ra μm | Cleanability | Brilliance Measurement at 20° | Brilliance Evaluation |
|---|---|---|---|---|
| 1 | 0.11 | X | 122.8 | X |
| 2 | 0.16 | ○ | 53.4 | X |
| 3 | 0.21 | ○ | 38.2 | ○ |
| 4 | 0.35 | ○ | 30.6 | ○ |
| 5 | 0.62 | ○ | 23.5 | ○ |
| 6 | 0.85 | ○ | 15.8 | ○ |
| 7 | 1.03 | ○ | 10.8 | ○ |
| 8 | 1.24 | Δ | 9.2 | ○ |
| 9 | 1.46 | X | 9.1 | ○ |
| 10 | 1.52 | X | 8.5 | ○ |

In table 3, the cleanability was measure in such a way that the sample sheet SP on which the image was formed was made pass through the sheet cleaning apparatus 20 of FIG. 3, and the after image of the sample sheet SP was visually evaluated at a spot immediately before the transferring portion 30 of the image forming apparatus 21. The sheet presenting no after image was evaluated as (0), and the other sheets were evaluated as (X).

The brilliance was evaluated in such a way that the brilliance was measured at a measuring angle of 20° using the brilliance meter VG-2000 (made by Nippon Denshoku Industry Co., Ltd.). The brilliance was evaluated as (○) when the measured value was 40 or smaller, and the others were evaluated as (X).

(Evaluation of Cleanability)

In Table 3, when the center line average roughness Ra was too small as in case of the sample sheet SP1 (Ra: 0.11 μm); the Funderworth Force of the toner particles becomes large and the adhering force is increased between the toner particles and the surface of the sheet surface layer 2, so that the toner particles become hard to be peeled off to cause an difficulty in cleaning.

On the contrary, when the center line average roughness a was large as in case of the sample sheet SP9 (Ra: 1.46 μm) and SP10 (Ra: 1.52 μm), the toner particles will get into concave and convex portions (uneven portions caused by surface roughness) of the surface of the sheet surface layer 2. Thereby, a contacting area will increased to cause difficulty in peeling off of toner particles.

Evaluation of Brilliance

When the center line average roughness Ra was too small as in case of the sample sheets SP1 (Ra: 0.11 μm) and SP2 (Ra: 0.16 μm), the regular reflection light quantity (brilliance) became large and the image became hard to be seen.

It became clear from the above evaluation that, when the center line average roughness Ra of the surface contacting with the toner particles on the sheet surface layer 2 was controlled approximately to about 0.2 μm or larger and 1.0 μm or smaller, a good cleanability was accomplished and a proper brilliance scarcely presenting after image of brilliance was obtained. Namely, a cycle stability was improved and it became possible to obtain an obvious and brilliance-controlled image.

4. Example Relating to Contained Component

In the following Table 4, eleven kinds of sample sheets SPn of the non-fixing type image receiving sheet S as illustrated in FIG. 1 were manufactured, and evaluations of the cleanability were compared on these sheets. The sample sheets SP2 through SP11 contained fine particles of titanium dioxide but made different in the content thereof. The remaining sample SP1 did not contain fine particles of titanium dioxide. In other words, the toner images were formed on the sample sheets SP1 through SP11, and the cleaning was carried out using the sheet cleaning apparatus 20 having the magnetic brush roller 25 shown in FIG. 3. Then, the toner images were removed so as to compare the cleanabilities.

A concrete manufacturing method of the sample sheets SP2 through SP11 containing titanium dioxide will described hereunder. Thermoplastic resin (high-molecular polyethylene) was coated uniformly on the sheet core layer 3 made of a paper, and fine particles of titanium dioxide (rutile-type titanium oxide (IV), made by Wako Junyaku Industry Co., Ltd.) were sprinkled over it. A shape forming mold was placed on the layer to carry out thermal pressing (at 120° C., for 30 min., with 10 kg/cm$^2$). Thereafter, the sheet was cooled and separated from the mold, thus the surface shape was transferred. The uneven shapes of this instance were a width of concave portion: 200 μm, a width of convex portion: 10 μm, a height: 50 μm. When the surface was observed, it was confirmed that the fine particles of titanium dioxide were buried in all over the resin layer. Concerning the sample sheet SP1 containing no titanium dioxide, the sprinkling process of titanium dioxide fine particles was eliminated from the above-mentioned manufacturing processes.

In place of the resin coating process, it is possible that a high-density polyethylene sheet film (made by Toyobo Co., Ltd., with a thickness of 30 μm) is placed on a plain paper, the fine particles of titanium dioxide are sprinkled on it in the same way, the shape forming mold is placed on it which in turn is subjected to thermal pressing (at 120° C., for 30 min., with 10 kg/cm$^2$). Thereafter, the sheet is cooled and separated from the mold, thus the surface shape is transferred.

Polymer materials such as polyethylene, polypropylene, stylene acryl, polyester etc. were used for a binder.

Two carriers: a conductive carrier comprising iron powder and an insulation carrier prepared by mixing resin and magnetite, were used for a carrier 45 of the magnetic brush for use in the magnetic brush roller 25 of the sheet cleaning apparatus 20 shown in FIG. 7.

(Evaluation of Cleanability)

The sample sheets SP1 through SP11 on which the images were formed were cleaned by the sheet cleaning apparatus 20 of FIG. 3 equipped with the conductive carrier or the insulation carrier, and the after images of sample sheets were visually evaluated. Sample sheets evaluated as "Very Good" were marked with (◎), those presenting no after image were marked with (○), and the others were marked with (X).

TABLE 4

| Sample sheet | Content of titanium dioxide (g/m$^2$) | Cleanability: Conductive carrier (Iron powder carrier) | Cleanability: Insulation carrier (resin carrier) |
|---|---|---|---|
| SP1 | 0.0 | ○ | X |
| SP2 | 0.05 | ○ | X |
| SP3 | 0.07 | ○ | Δ |
| SP4 | 0.1 | ◎ | ◎ |
| SP5 | 0.5 | ◎ | ◎ |
| SP6 | 1.0 | ◎ | ◎ |
| SP7 | 1.5 | ◎ | ◎ |
| SP8 | 2.0 | ◎ | ◎ |
| SP9 | 2.05 | ○ | Δ |
| SP10 | 2.1 | Δ | Δ |
| SP11 | 2.5 | X | X |

In Table 4, the removability of toner image (cleanability) was very excellent (◎) for both the conductive carrier and the insulation carrier, when the content of titanium dioxide fine particle was set to within a range between 0.1 g and 2.0 g as in case of the sample sheet to which the present application was applied, especially in the sample sheets SP1 through SP8.

The reason is that a friction charge on the sheet surface layer (media) 2 produced between the sheet surface layer 2 and the carrier 45 of the magnetic brush, is released quickly and properly by the fine particles of titanium dioxide so as to prevent the sheet surface layer 2 from being charged to a large amount.

In case of the sample sheet SP1 containing no fine particle of titanium dioxide, the cleanability was evaluated as good (○) at present for the conductive carrier but evaluated as bad (X) for the insulation carrier, and a residual amount of the toner particles after cleaning was large.

Such an effect was confirmed not only in the fine particles of titanium dioxide, but also in zinc oxide, alumina and calcium carbonate etc., too. As in case of the sample sheets SP4 through SP8 listed in Table 4, very good results were obtained when additions of the above components were set to values ranging between 0.1 g to 2 g per square meter of image receiving sheet.

In case where the content of titanium dioxide exceeded 2 g, the roughness of sheet surface became large to cause a difficulty in peeling off of toner, as obvious from the sample sheets SP9 through SP11.

5. Embodiment 2

(Image Forming Apparatus)

Figure 8:
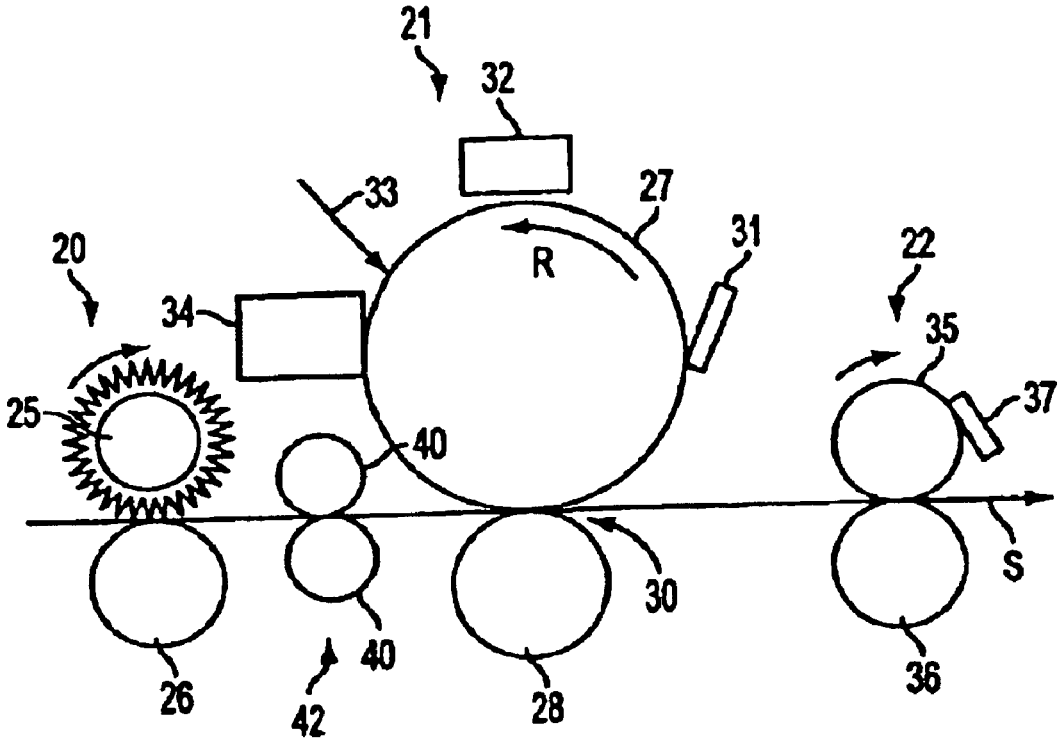
FIG. 8 is a simplified side view of the image forming apparatus to which the inventions cited in claims 12 & 13 of this application are applied.

FIG. 8 shows one example of the image forming apparatus to which the invention of claim 13 of this application is applied. The sheet cleaning apparatus (toner removing apparatus) 20, the pre-charging sheet charging apparatus 42, the transferring apparatus 21 and the convex stripe cleaning apparatus (convex stripe toner removing apparatus) 22 are disposed, in this order from the feed-start side (left side of FIG. 8) of the image receiving sheet. Namely, the sheet charging apparatus 42 is disposed at the feed-start side of the transferring apparatus 21 for serving as a pre-process of the transferring process.

The sheet cleaning apparatus 20 is composed of a collecting conductive brush roller 25 and a counter roller 26.

The sheet charging apparatus 42 is composed of a pair of sheet cleaning rollers 40. One roller 40 is connected to a power source adjustable in its applied voltage, and the other roller 40 is grounded, for instance. The image receiving sheet S is sandwiched between the both rollers 40 and applied with a bias voltage, so that the surface of the image receiving sheet is charged to a desired polarity and a charged quantity. In case when the toner particles are charged to a negative polarity, the surface of the image receiving sheet is charged to a positive polarity. In this instance, the roller system is shown as the sheet charging apparatus 42 in FIG. 8, however, it is possible to utilize a charger or a discharger.

The transferring apparatus 21 is composed of the drum-type photoreceptor 27 and a transferring roller 28 facing on it. A toner wiping-off portion (scratching portion) 31, an image charging portion 32, an exposing portion 33 and a developing portion 34 are disposed around the photoreceptor 27 in this order, in a direction from the transferring portion 30 contacting with the transferring roller 28 to the drum rotation direction R side. The transferring roller 28 is applied with a bias to draw the toner particles.

The convex stripe cleaning apparatus 22 is composed of a charging roller 35 and a counter roller 36, and a toner wiping-off portion 37 is disposed on the charging roller 35.

(Image Forming Method)

The image forming method will be described hereunder, according to the claim 13 using the image forming apparatus of FIG. 8.

(1) The transferring apparatus 21 uniformly charges the surface of the photoreceptor 27 for about −900V in a region of the image charging portion 32, and carries out the exposure operation according to the image data to form the electrostatic latent image on the surface of the photoreceptor 27 in a region of the exposing portion 33. An exposed part of the surface of the photoreceptor 27 decays to about −100V, and a non-exposed part of it is retained to about −900V. Thereafter, the toner particles (negative polarity) are made adhere to the photoreceptor 27 according to the electrostatic latent image in the developing portion 34.

(2) When the image receiving sheet S is to be reused, the toner particles in the grooved stripe portion 5 are removed in the cleaning apparatus 20 once. Even when the sheet is not reused, the surface is cleaned as occasion demands, then the sheet is transported to the sheet charging apparatus 42.

(3) In the sheet charging apparatus 42, the surface of the image receiving sheet S is charged to a polarity (positive polarity) opposite to a charged polarity (negative polarity) of the toner particles. For example, a voltage ranging from +1000V to +2000V is applied on the sheet charging roller 40, thereby the surface of the image receiving sheet S is applied with a voltage ranging from about +200V to +800V. In this way, the surface of the image receiving sheet S is charged with a positive voltage, then transported to the transferring portion 30 of the transferring apparatus 21.

(4) In the transferring portion 30 of the transferring apparatus 21, the toner particles of the electrostatic latent image adhering to the photoreceptor 27 are transferred onto the uneven surface of the image receiving sheet S being transported. In this instance, a bias applied on the transferring roller 28 is applied after being adjusted to several hundred volts so that an appropriate image density can be obtained, in consideration of a charged quantity which is charged to the image receiving sheet S itself.

FIG. 4 is the enlarged view of the transferring portion 30. The negative-charged toner particles 10 adhering to the surface of the photoreceptor 27 are drawn by the positive charge on the surface of the image receiving sheet S and the positive charge on the transferring roller 28, thus being transferred to the surface of the image receiving sheet S.

Almost all of the transferred toner particles will adhere to the bottom face of the grooved concave portion 5, but a part of them will adhere also to the convex stripe portion 6.

(5) The image receiving sheet S on which the toner image is transferred is transported to the convex stripe cleaning apparatus 22 of FIG. 8, and the toner particles 10 adhering to the convex stripe portion 6 by means of an electrostatic force of the charging roller (positive charge) 35 are collected as illustrated by FIG. 5. In this instance, the charging roller 35 is applied with a bias of about +300V, and the counter roller 36 is grounded.

Figure 6:
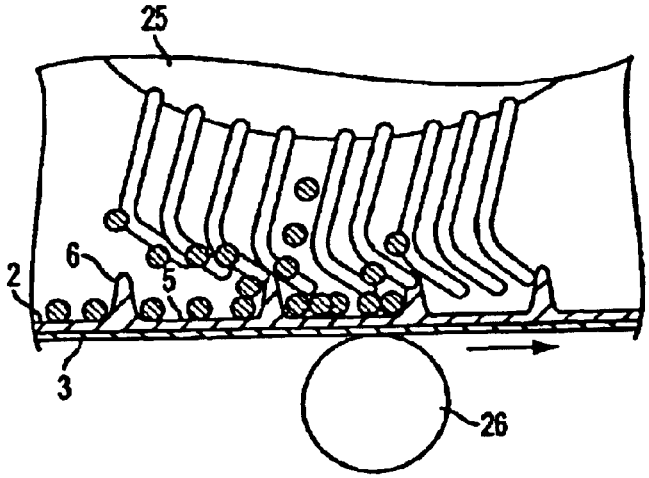
FIG. 6 is an enlarged vertical sectional view of a cleaning apparatus (image removing apparatus).

(6) In case where the image receiving sheet S on which the image is formed is to be reused, it is transported to the sheet cleaning apparatus 20 in FIG. 8 and the toner particles adhering to the concave portion 5 are collected. In FIG. 6 or FIG. 7, the collecting conductive brush roller 25 is applied with a bias of about +1 kV to a polarity opposite to the toner particle charging polarity. The counter roller 26 is grounded.

6. Example Relating to Pre-Charging

The following Table 5 shows comparisons between the transferability, the retentivity and the cleanability for various values of roller applied voltage of the sheet charging apparatus 42. In this instance, the image receiving sheet S is used on which the continuous grooved concave portion 5 of FIG. 1 and the ridge-shape convex portion 6 extending along the former, and the toner image is formed by the image forming apparatus having the sheet charging apparatus 42 as illustrated by FIG. 8.

A concrete manufacturing method of the image receiving sheet using Table 5 will be described hereunder. The thermoplastic resin (high-molecular polyethylene) was uniformly coated on the sheet core layer 2, the shape forming mold (silicon rubber) was placed on it. The sheet was subjected to the thermal pressing (at 120° C., for 30 min., with 10 kg/cm$^2$), then the sheet was cooled and separated from the mold. Thus, the surface shape was transferred. The uneven shape of this instance was as follows, in FIG. 1; a width of the concave portion W1=200 $\mu$m, a width of the convex portion W2=10 $\mu$m and a height D(H)=50 $\mu$m. A plain paper generally used in copying machines and printers was used for material of the sheet core layer 2.

In place of coating the resin, it is possible to use a high-density polyethylene sheet film (made by Toyobo Co., Ltd., thickness: 30 $\mu$m.) placed on the plain paper, to place the shape forming mold on it in the same way, then to carry out the thermal pressing (at 120° C., for 30 min., with 10 kg/cm$^2$). The film was cooled and separated from the mold, thus the surface shape can be transferred.

A bias voltage of about +1 kV was applied on the transferring roller 28 of the transferring apparatus 21 when the applied voltage of the sheet charging apparatus 42 was zero, and the bias voltage was adjusted to about several hundred volts in order to obtain the most suitable image density when the other applied voltage ranged from 500V to 4000V.

(Evaluation of Transferability)

In relation to a toner adhering quantity on the photoreceptor 27 before being transferred, a toner adhering quantity transferred on the image receiving sheet S was measured. A percentage of the transferred toner particles of 90% or larger was evaluated as the best (◎), that of 80% or larger was evaluated as good (○), and that of smaller than 80% was evaluated as bad (X).

(Evaluation of Retentivity)

Plural image receiving sheets on which the images were formed were put upon another, and contaminated states on sheet backsides were visually evaluated. Sheets entirely not contaminated were evaluated as (◎), those not contaminated were evaluated as (○), and the others were evaluated as (X).

(Evaluation of Cleanability)

The image receiving sheet on which the image was formed was made pass through the sheet cleaning apparatus 20, and the after image of the image receiving sheet immediately before being transferred was visually evaluated. Sheets including no after image were evaluated as good (○), and the others were evaluated as bad (X).

TABLE 5

| Pre-charging roller applied voltage | Transferability | Retentivity | Cleanability |
|---|---|---|---|
| 0 | ○ | ○ | ○ |
| 500 | ○ | ○ | ○ |
| 1000 | ◎ | ◎ | ○ |
| 1500 | ◎ | ◎ | ○ |
| 2000 | ◎ | ◎ | ○ |
| 2500 | ○ | ○ | ○ |
| 3000 | ○ | ○ | X |
| 4000 | ○ | X | X |

As listed in the top numerical line of Table 5, even when the roller applied voltage given by the sheet charging apparatus is zero, i.e. the pre-charging is not done; some good results are obtained in the transferability and the retentivity by raising the applied voltage of the transferring roller 28 at time of transferring up to about +1 kV.

As listed in the third to fifth numerical lines of Table 5, the transferability and the retentivity are improved and the best results are obtained in case where the roller applied voltage are 1000V, 1500V and 2000V under the pre-charged condition, as compared with the case where the pre-charging is not done. As for the cleanability, it is not affected to present no change in its performance even when the image receiving sheet is charged with a polarity opposite to the toner particles, at least within a range up to 2500V of the roller applied voltage under the pre-charged condition.

When the roller applied voltage is too high as like 4000V, for example; it becomes clear that a discharging phenomenon will occur to cause a decrease in the transferability and the retentivity.

7. Other Embodiment

Figure 9:
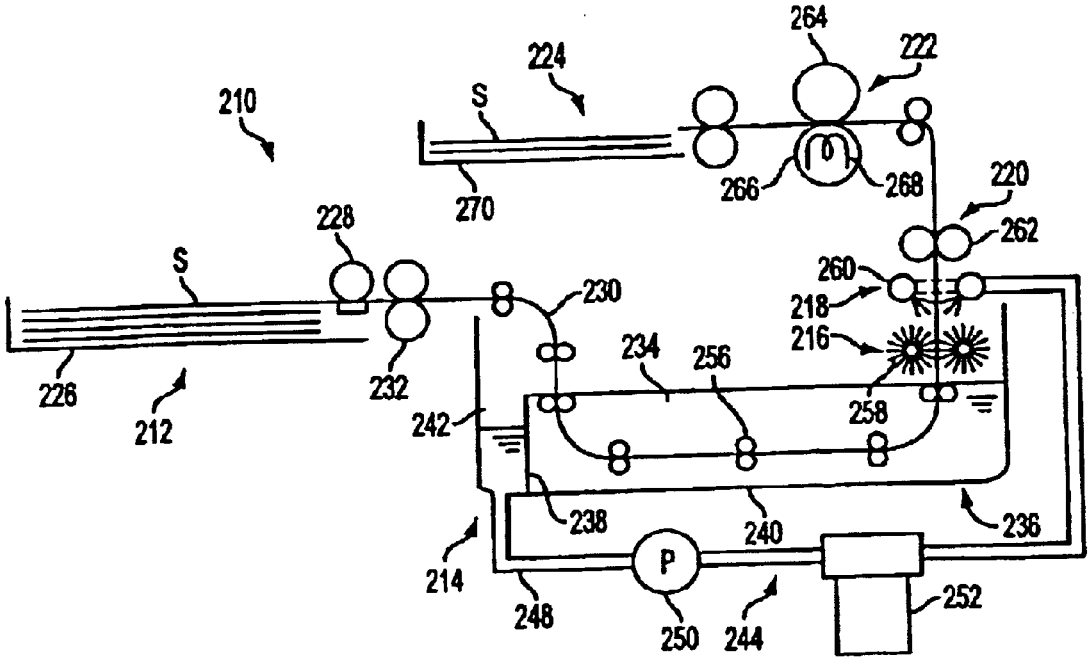
FIG. 9 is a simplified side view showing a wet-type of image forming apparatus.
Figure 10:
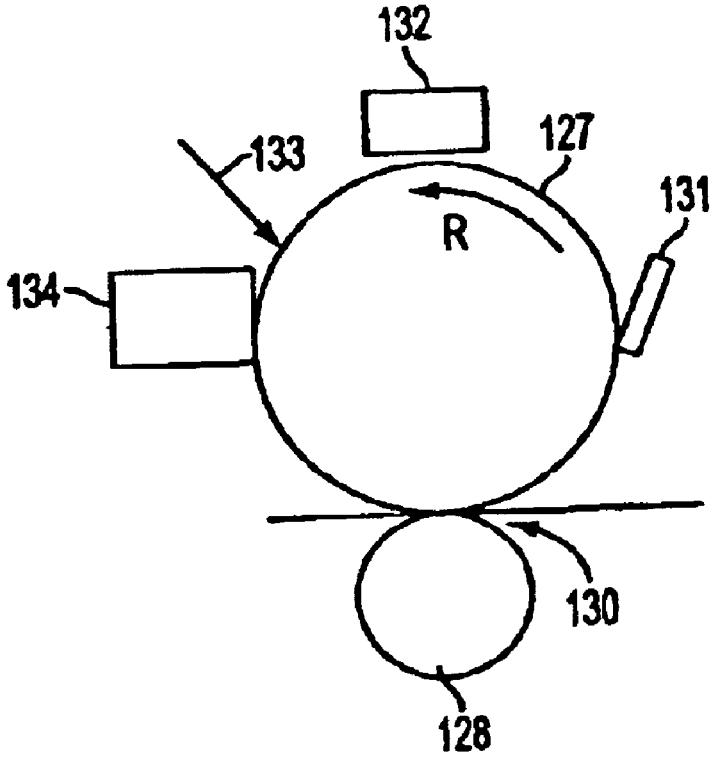
FIG. 10 PRIOR ART
FIG. 10 is a simplified side view showing an example of conventional image forming apparatus.
Figure 11:
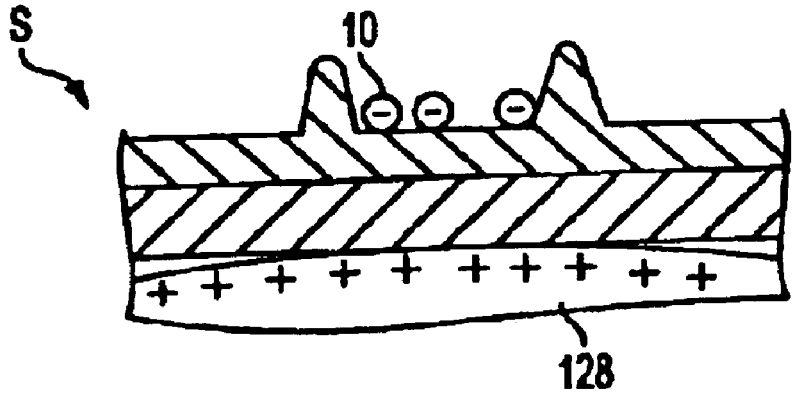
FIG. 11 PRIOR ART
FIG. 11 is an enlarged vertical sectional view showing a transferring process in a conventional transferring portion.

In place of the dry-type sheet cleaning apparatus (image removing apparatus) 20 as illustrated in FIG. 3, it is possible to utilize an image removing apparatus 210 in which liquid is given to the image receiving sheet in order to remove the toner on the concave portion of the image receiving sheet, and the sheet is recycled to a reusable state as illustrated in FIG. 9. The image removing apparatus 210 of FIG. 9 will be described hereunder.

(Approximate Structure of Image Removing Apparatus)

The image removing apparatus 210 approximately consists of a sheet feeding portion 212 which accommodates and supplies the image receiving sheets recycled in this apparatus 210, an impregnating portion 214 which gives liquid to the image receiving sheet S sent out from the sheet feeding portion 212 so as to moisten the image receiving sheets S, a toner removing portion 216 which removes the toner from the image receiving sheet given with liquid, a rinsing portion 218 which sprays liquid on the image receiving sheet S from which the toners have been removed, in order to remove foreign matters such as toner etc. remaining on the image receiving sheet S, a liquid removing portion 220 which removes liquid adhering to the surface of the image receiving sheet S from which the toners have been removed, a drying portion 222 which dries the image receiving sheet S from which liquid has been removed to a reusable state, and a sheet discharging portion 224 which discharges and accommodates the dried image receiving sheet S.

(Sheet Feeding Portion)

The sheet feeding portion 212 has a feeding tray 226 accommodating the image receiving sheet S. Further, the sheet feeding portion 212 has a dividing mechanism 228 which divides and sends only the top-positioned sheet among plural image receiving sheets S laid and accommodated in the feeding tray 226, and a feeding-out mechanism 232 which feeds out the top-positioned sheet divided from a lower layer sheet by the dividing mechanism 228 along a sheet transporting path 230. In this embodiment, a dividing apparatus 232 having a pick-up roller contacting with the top-positioned sheet and a dividing pad contacting with an outer peripheral face of the pick-up roller, is used for the dividing mechanism 228. However, a dividing mechanism having another structures may be used. Such a roller transporting apparatus utilized in a sheet transporting apparatus for conventional copying machine and printer etc., is used for the feeding out mechanism 232; in which a first shaft connected to a drive system and a second shaft disposed in parallel with the former are installed, plural rollers (rubber rollers, for instance) are fitted to these shafts with specified distances put between them, the sheet is transported by being sandwiched between a roller fitted to one-side roller and a roller fitted to the other-side roller.

(Impregnating Portion)

The impregnating portion 214 has a container 236 accommodating a cleaning solution (liquid) 234. Water is used for the cleaning solution. In order to easily remove a toner adhering to the image receiving sheet S, a surface active agent may be added by about 0.01% (weight of surface active agent/weight of water). Other materials may be added to the cleaning solution as occasion demands.

An inside space of the container 236 is divided by an overflow wall 238 into an impregnating tank 240 for impregnating the image receiving sheet S and an overflow tank 242 accommodating the cleaning solution which overflows from the impregnating tank 240. The container 236 is also provided with a solution circulating portion 244 which sends the cleaning solution 234 flowing from the impregnating tank 240 into the overflow tank 242 while overflowing the overflow wall 238, again into the impregnating tank 240 and which collects foreign matters (toner, for instance) contained in the cleaning solution 234 in a course of sending the cleaning solution from the overflow tank 242 into the impregnating tank 240.

The solution circulating portion 244 has a solution circulating path 248. The solution circulating path 248 is connected to the overflow tank 242 at its one end and is located at an upper part of the impregnating tank 240 at the other end. Consequently, the cleaning solution 234 accumulating in the overflow tank 242 is supplied to the impregnating tank 240 from above a liquid surface. The solution circulating path 248 has a pump 250 for forcibly circulating the cleaning solution 234 along the solution circulating path 248, and a filter portion 252 for removing the foreign matters contained in the cleaning solution 234.

In order to keep a liquid surface height of the overflow tank 242 at a constant level, such a design may be employed that the liquid surface height is measured and the cleaning solution is supplemented from a not-shown reserve tank to the impregnating tank 240 when the liquid level in the overflow tank 242 lowers below a specified level.

In the impregnating tank 240 of the container 236, there installed plural transporting mechanisms 256 and guide members (not shown) for guiding the image receiving sheet S between these plural transporting mechanisms 256, in order to transport the image receiving sheet S sent from the sheet sending portion 212 along the sheet transporting path 230 through the cleaning solution 234 in the impregnating tank 240. The above-mentioned roller transporting apparatus is used for the transporting mechanism 256. A pair of guide plates (plates having plural openings for allowing the cleaning solution 234 come and go freely) which sandwiches the sheet transporting path 230 and faces each other with a specified distance left between them, or guide wires (wires extending in a sheet transporting direction and disposed with a specified distance left between them at right angle to the sheet transporting direction) can be used preferably.

(Toner Removing Portion)

The toner removing portion 216 has a pair of brush rollers 258 which sandwiches the sheet transporting path 230 and face each other. The roller 258 is composed of a shaft which is connected to the drive system and around which a base cloth flocked with nylon fabric is wound, and the rollers are so disposed that bristles of the brush rollers 258 are made contact with front and back sides of the image receiving sheet S transported along the sheet transporting path 230 respectively. In order to remove the toner adhering to the front and back sides of the image receiving sheet S passing between the brush rollers 258 which contact with the toner, the rollers are connected to and driven by a not-shown motor.

A peripheral speed of the brush roller 258 is set to several times to several ten times as high as a transporting speed of the image receiving sheet S. Briefly explaining a rotation direction of the brush roller 258, it is preferable to control the drive motor of the brush roller 258 in such a way that bristle tip ends of brush roller 258 move in the sheet transporting direction when the tip end of the image receiving sheet S come in the facing portion of the brush roller 258, and that the bristle tip ends move in a direction opposite to the sheet transporting direction after the tip end of the image receiving sheet S passes through the facing portion.

In FIG. 9, the brush 258 is used for the member contacting with the image receiving sheet S to remove the toner from the image receiving sheet S. However, a roller may be used which is fitted with a sponge or a soft member such as a cloth etc. around the rotating shaft.

(Rinsing Portion)

The rinsing portion 218 has spray nozzles 260 sandwiching the sheet transporting path 230 and disposed at upper parts of the brush rollers 258, in order to supply the cleaning solution 234 to the front and back sides of the image receiving sheet S passing or having passed through between the pair of the brush rollers 258. The spray nozzle 260 is connected to the other end of the solution circulating path 248, and the filtrated cleaning solution 234 is supplied by the solution circulating path 248. In this embodiment, the spray nozzle 260 is formed by bending a pipe with an angle of 180°, on which solution injection ports are made with specified distances left between them.

As illustrated in the figure, the reason why the brush rollers 258 and the spray nozzles 260 are installed on both sides of the sheet transporting path, is that the removal of image can be done securely even when the image receiving sheet S is placed on the supply tray 226 with its uneven surface placed upside or downside.

(Solution Removing Portion)

The solution removing portion 220 has squeezing rollers 262 which face each other sandwiching the sheet transporting path 230 and comprise two rollers contacting each other on the sheet transporting path 230. One of these two rollers composing the pair of squeezing rollers 262 is connected to and driven by a not-shown motor.

(Drying Portion)

The drying portion 222 is disposed at a downstream side of the solution removing portion 220 in order to dry the image receiving sheet S from which the cleaning solution has been removed, up to a reusable state in the image forming apparatus. In this embodiment, the drying portion 222 is composed of two rollers 264 and 266 which face each other sandwiching the sheet transporting path 230 and contact each other on the sheet transporting path 230. At least one roller 266 of these rollers 264 and 266 is provided with a heater 268 serving as a heat source in its inside.

In place of the above-mentioned roller-type heating unit, a blower which only blows air of room temperature against the sheet or a heater-incorporated blower which can also blow out hot air, may be used for the drying means of the drying portion 222. Further, an unit which blows air dried by a dehumidifier may be used.

(Sheet Discharging Portion)

The sheet discharging portion 224 has a discharging tray 270 which lays and accommodates the image receiving sheets S dried by the drying portion 222.

(Sheet Recycling Treatment)

A function of the image removing apparatus 210 having the above structure will be described hereunder. In concrete, the image receiving sheets S to be recycled are laid and accommodated in the feeding tray 226. When the apparatus 210 is started and operated from this state, the plural image receiving sheets S accommodated in the feeding tray 226 are sent out one by one from the top-positioned sheet by the dividing mechanism 228, then fed to the impregnating portion 214 by the sending-out mechanism 232.

The image receiving sheets S supplied to the impregnating portion 214 are transported by the transporting mechanism 256 while being guided by the guide members, the sheets are impregnated in the cleaning solution 234 in the impregnating tank 240 for a specified time, and the cleaning solution 234 penetrates in the concave portion on the sheet surface layer of the image receiving sheet S. Thereby, the adhering force between the surface and the toner adhering to the concave portion on the surface of the image receiving sheet S is lost, so that the toner will be brought into a separable state by only giving a mechanical force. The image receiving sheet S discharged from the cleaning solution 234 in the impregnating tank 240 is subjected to a sliding friction force from the pair of the brush rollers 258 at both front and back sides, and toners adhering to the both front and back sides are removed. In this instance, the cleaning solution 234 is sprayed from the spray nozzles 260 onto the front and back sides of the image receiving sheet S, and the toners adhering to a sheet area passing the facing portions of the brush rollers 258 are washed off. The toners adhering to the brush rollers 258 are washed down to the impregnating tank 240.

The toner fell on the impregnating tank 240 or the toner separated from the image receiving sheet S in a course of the image receiving sheet S being transported through the impregnating tank 240, flows into the overflow tank 242 together with the cleaning solution 234 which flows from the impregnating tank 240 over the overflow wall 238 into the overflow tank 242. The toner contained in the cleaning solution 234 in the overflow tank 242 is fed by the pump 250 in and through the solution circulating path 248 and removed by the filter portion 252. The cleaning solution 234 from which the toner is removed is separated from the spray nozzles 260 onto the front and back sides of the image receiving sheet S and the brush roller 258.

The image receiving sheet S from which the toner is removed is sandwiched between and pressed by the pair of the squeezing rollers 262 of the solution removing portion 220, and the cleaning solution 234 on the surface is removed. Then, the image receiving sheet S is fed to the drying portion 222 and dried. Thereafter, it is discharged onto the discharging tray 270 of the sheet discharging portion 224.

What is claimed is:

1. An image forming apparatus for a non-fixing type image receiving sheet to which toner particles are made adhere in a removable manner, wherein a large number of concave portions accepting toner particles and a large number of convex portions protecting toner particles are formed on a surface of the image receiving sheet, and there are installed two apparatuses:

a transferring apparatus which transfers a toner image to the surface of image receiving sheet, and a sheet charging apparatus which charges the surface of the image receiving sheet to a polarity opposite to a charged polarity of toner particles, in advance of a transferring process carried out by the transferring apparatus.

2. An image forming apparatus for a non-fixing type image receiving sheet as set forth in claim 1, wherein the sheet charging apparatus includes a sheet charging roller connected to a power source adjustable in its applied voltage.

3. An image forming apparatus for a non-fixing type image receiving sheet as set forth in claim 1, wherein the sheet charging apparatus has a larger absolute voltage than that of a desired charged potential.

4. An image forming apparatus for a non-fixing type image receiving sheet as set forth in claim 1, further comprising:

a sheet cleaning apparatus located upstream of the sheet charge apparatus in a feeding direction.

5. An image forming apparatus for a non-fixing type image receiving sheet as set forth in claim 4, wherein the sheet cleaning apparatus includes a conductive brush roller.

6. An image forming apparatus for a non-fixing type image receiving sheet as set forth in claim 4, wherein the sheet cleaning apparatus removes the toner in a dry manner.

7. An image forming apparatus for a non-fixing type image receiving sheet as set forth in claim 1, wherein the sheet cleaning apparatus removes the toner in a wet manner.

8. An image forming apparatus for a non-fixing type image receiving sheet as set forth in claim 1, further comprising a convex cleaning apparatus located downstream of the transferring apparatus in a feeding direction.

9. An image forming apparatus for a non-fixing type image receiving sheet as set forth in claim 8, wherein the convex cleaning apparatus includes a roller and a toner wiping-off portion.

10. An image forming apparatus for a non-fixing type image receiving sheet as set forth in claim 1, wherein the transferring apparatus includes a transferring member applied with a bias voltage to draw the toner particles.

11. An image forming apparatus for a non-fixing type image receiving sheet as set forth in claim 1, wherein a toner image is formed on an image holding body in an electrophotographic manner.

12. An image forming apparatus for a non-fixing type image receiving sheet as set forth in claim 1, wherein the sheet has a continuous grooved concave-convex.

13. An image forming apparatus for a non-fixing type image receiving sheet as set forth in claim 1, wherein the sheet is composed of a base layer and a concave-convex layer thereon.

14. An image forming apparatus for a non-fixing type image receiving sheet as set forth in claim 1, wherein a roughness of the sheet surface is between 0.2 $\mu$m and 1.0 $\mu$m.

15. An image forming apparatus for a non-fixing type image receiving sheet as set forth in claim 1, wherein the surface of the sheet is made of polymer including fine particles of metal oxide.

16. An image forming apparatus for a non-fixing type image receiving sheet to which toner particles are made to adhere in a removable manner, wherein a large number of concave portions accepting toner particles and a large number of convex portions protecting toner particles are formed on a surface of the image receiving sheet, and there are installed two apparatuses:

a transferring apparatus which transfers a toner image to the surface of image receiving sheet and, a sheet charging apparatus which charges the surface of the image receiving sheet to a polarity opposite to a charged polarity of toner particles, in advance of a transferring process carried out by the transferring apparatus, and the transferring apparatus includes a photoreceptor, an exposing portion and a developing portion.

17. An image forming apparatus for a non-fixing type image receiving sheet as set forth in claim 16, wherein the charging apparatus charges the photoreceptor to a same polarity as a charged polarity of the toner particles.

18. An image forming apparatus for a non-fixing type image receiving sheet to which toner particles are made to adhere in a removable manner, wherein a large number of concave portions accepting toner particles and a large number of convex portions protecting toner particles are formed on a surface of the image receiving sheet, and there are installed four apparatuses:

a transferring apparatus which transfers a toner image to the surface of image receiving sheet, a sheet charging apparatus which charges the surface of the image receiving sheet to a polarity opposite to a charged polarity of the toner particles, in advance of a transferring process carried out by the transferring apparatus, a sheet cleaning apparatus which is located upstream of the sheet charging apparatus in a feeding direction and, a convex stripe cleaning apparatus which is located downstream of the transferring apparatus in the feeding direction.

19. An image forming apparatus for a non-fixing type image receiving sheet as set forth in claim 18, wherein the sheet charging apparatus has a larger absolute voltage than that of the convex cleaning apparatus.

20. An image forming apparatus for a non-fixing type image receiving sheet to which toner particles are made to adhere in a removable manner, wherein both cleaning apparatuses clean the sheet by charging it to a polarity opposite to a charged polarity of the toner particles.

* * * * *

UNITED STATES PATENT AND TRADEMARK OFFICE

CERTIFICATE OF CORRECTION

PATENT NO. : 6,775,507 B2
DATED : August 10, 2004
INVENTOR(S) : Masahiko Matsuura et al.

It is certified that error appears in the above-identified patent and that said Letters Patent is hereby corrected as shown below:

Column 22,
Line 67, change "claim 1" to -- claim 4 --.

Signed and Sealed this

Fourteenth Day of December, 2004

JON W. DUDAS
*Director of the United States Patent and Trademark Office*